US009251938B2

(12) United States Patent
Kandapallil et al.

(10) Patent No.: US 9,251,938 B2
(45) Date of Patent: Feb. 2, 2016

(54) SOFT MAGNETIC PHASE NANOPARTICLES PREPARATIONS AND ASSOCIATED METHODS THEREOF

(71) Applicant: General Electric Company, Schenectady, NY (US)

(72) Inventors: Binil Itty Ipe Kandapallil, Mechanicville, NY (US); Robert Edgar Colborn, Niskayuna, NY (US); Peter John Bonitatibus, Jr., Saratoga Springs, NY (US); Francis Johnson, Clifton Park, NY (US)

(73) Assignee: General Electric Company, Niskayuna, NY (US)

( * ) Notice: Subject to any disclaimer, the term of this patent is extended or adjusted under 35 U.S.C. 154(b) by 443 days.

(21) Appl. No.: 13/788,218

(22) Filed: Mar. 7, 2013

(65) Prior Publication Data

US 2014/0252264 A1 Sep. 11, 2014

(51) Int. Cl.

| | |
|---|---|
| ***H01F 1/01*** | (2006.01) |
| ***B22F 1/00*** | (2006.01) |
| ***B22F 9/24*** | (2006.01) |
| ***H01F 1/00*** | (2006.01) |

(52) U.S. Cl.

CPC ..... *H01F 1/0054* (2013.01); *B22F 1/0018* (2013.01); *B22F 9/24* (2013.01)

(58) Field of Classification Search

CPC ..... H01F 1/065; H01F 1/0054; B22F 1/0018; B22F 9/24; B82Y 25/00

USPC ..... 148/100, 105, 121, 122; 252/62.51 R, 252/62.55

See application file for complete search history.

(56) References Cited

U.S. PATENT DOCUMENTS

| | | | | |
|---|---|---|---|---|
| 6,262,129 | B1 | 7/2001 | Murray et al. | |
| 7,022,156 | B2 * | 4/2006 | Hattori et al. | 75/351 |
| 7,029,514 | B1 | 4/2006 | Yang et al. | |
| 7,407,527 | B2 * | 8/2008 | Hyeon | 75/351 |
| 7,527,875 | B2 | 5/2009 | Mizuno et al. | |
| 7,964,013 | B2 | 6/2011 | Misra | |
| 8,110,021 | B2 * | 2/2012 | Zhong et al. | 75/351 |
| 8,110,510 | B1 * | 2/2012 | Fanfair et al. | 438/800 |
| 8,414,678 | B2 * | 4/2013 | Kumar et al. | 75/362 |
| 2005/0214190 | A1 | 9/2005 | Hyeon et al. | |
| 2006/0068217 | A1 * | 3/2006 | Mizuno et al. | 148/300 |
| 2007/0249747 | A1 * | 10/2007 | Tsuji et al. | 522/3 |

OTHER PUBLICATIONS

Sun et al., "Synthesis of monodisperse cobalt nanocrystals and their assembly into magnetic superlattices (invited)"; J. Appl. Phys., vol. 85, No. 8; Apr. 1999; pp. 4325-4330.*

(Continued)

*Primary Examiner* — Helene Klemanski

(74) *Attorney, Agent, or Firm* — Paul J. DiConza

(57) ABSTRACT

A method of synthesizing magnetic nanoparticles comprising soft magnetic phases is provided, wherein the method comprises degassing a first mixture at a temperature in a range from about 80° C. to 130° C. The first mixture comprises a solvent, a compound comprising iron, cobalt, or combinations thereof dissolved in the solvent, and an organic component comprising a fatty acid or an amine. Degassing the first mixture is followed by adding a capping ligand to the first mixture under inert atmosphere to form a second mixture; adding a reducing agent to the second mixture at a temperature in a processing temperature range from about 250° C. to about 350° C. to form a third mixture; and incubating the third mixture at a temperature within the processing temperature range to form nanoparticles comprising a soft magnetic phase.

26 Claims, 7 Drawing Sheets

(56) References Cited

OTHER PUBLICATIONS

Taeghwan Hyeon, "Chemical Synthesis of Magnetic Nanoparticles", Chemical Communications, 2003, pp. 927-934.
Srivastava et al., "Formation mechanism and composition distribution of FePt nanoparticles", Journal of Applied Physics, vol. 102, 2007, pp. 104310-1-104310-8.
Abhishek Singh, "Size Control and Characterization of Colloidal Magnetic Cobalt Nanoparticles", Master's Theses, Chemical and Materials Engineering—San Jose State University, Aug. 2008, 84 Pages.
Majid Farahmandjou, "Effect of Oleic Acid and Oleylamine Surfactants on the Size of FePt Nanoparticles", Journal of Superconductivity and Novel Magnetism, vol. 25, 2012, pp. 2075-2079.
Zhang et al., "Controlled Synthesis of Monodisperse Magnetic Nanoparticles in Solution Phase", The Open Surface Science Journal, 2012, vol. 4, (Suppl 1: M2), pp. 26-34.

* cited by examiner

SOFT MAGNETIC PHASE NANOPARTICLES PREPARATIONS AND ASSOCIATED METHODS THEREOF

STATEMENT OF GOVERNMENT INTEREST

This invention was made with Government support under grant number DE-AR0000158 awarded by the Advanced Research Projects Agency-Energy (ARPA-E). The Government has certain rights in the invention.

FIELD OF THE INVENTION

The invention relates to magnets, and more particularly to nanoparticles comprising a soft magnetic phase and methods of making the same.

BACKGROUND

Magnetic nanoparticles have drawn attention as essential materials for achieving a variety of next-generation nanotechnology devices, such as high-density magnetic recording media, nanoscale electronics, radio-frequency electromagnetic wave shields, nanocomposite permanent magnets or transformer core. In the biomedical field, the magnetic nanoparticle has potential applications as novel catalysts, biomolecule labeling agents or used as contrast agent for magnetic resonance imaging (MRI). The magnetic nanoparticle further used for hyperthermia, immunological test systems, drug targeting or gene delivery. A nanocomposite permanent magnet comprising a hard magnetic phase nanoparticles and soft magnetic phase nanoparticles may have immense significance to enhance intrinsic coercivity of the permanent magnets, which may demonstrate enhanced performance at high temperatures. Magnetically soft materials with low anisotropy are advantageous in the development of read heads and in magnetic shielding applications. A steady supply of magnetic nanoparticles comprising soft magnetic phases with desirable size and magnetic properties is necessary for various applications.

Methods have been developed with primary focus to prepare nanoparticles of desired size by controlling the particle growth, however the exact details of the magnetic properties of the resulting particles are unknown. Soft magnetic nanoparticles with a high magnetic saturation are primary requirement for making a nanocomposite magnet. Thus the ability to obtain soft magnetic nanoparticles with magnetic properties approaching maximum magnetic saturation in the bulk is a desirable quality. Unlike previously reported processes on the synthesis of soft magnetic nanoparticles using iron (II) compounds and with zero valent iron precursors, a process for producing small nanoparticles, such as 5 nm to 20 nm, with magnetic saturation values approaching maximum is a long felt need.

A secondary requirement for a nanocomposite magnet is to minimize the non-magnetic material in the protective shell of the soft magnetic nanoparticle, to allow optimal coupling between the soft magnetic phase and hard magnetic phase. Methods that have been established using long chain surfactants for stabilization of small particles exhibit lower magnetic saturation (emu/g) due to ligand effects. Various attempts of heat-treatment have resulted in uncontrolled growth of the nanoparticles.

Therefore, the development of a method for synthesizing uniform nanoparticles comprising soft magnetic phases comprised of a metal or an alloy having desired particle diameter, particle size distribution, improved crystallinity, phase structure or phase purity is desired. Moreover, an economically feasible method for making magnetic nanoparticles with improved magnetic properties compared to commercially available or conventionally made magnetic nanoparticles may provide a solution for the current requirement.

BRIEF DESCRIPTION

One or more embodiments of a method are provided, wherein the method comprises degassing a first mixture at a temperature in a range from about 80° C. to 130° C. The first mixture comprises a solvent, a compound comprising iron, cobalt, or combinations thereof dissolved in the solvent, and an organic component comprising a fatty acid or an amine. The degassing is followed by adding a capping ligand to the first mixture under inert atmosphere to form a second mixture; adding a reducing agent to the second mixture at a temperature in a processing temperature range from about 250° C. to about 350° C. to form a third mixture; and incubating the third mixture at a temperature within the processing temperature range to form nanoparticles comprising a soft magnetic phase.

In another embodiment, a method comprises degassing a first mixture at a temperature of about 100° C., wherein the mixture comprises diphenyl ether as a solvent, an iron bromide dissolved in diphenyl ether, and an organic component comprising a fatty acid or an amine having 10 to 20 carbon atoms; adding trioctylphosphine under inert atmosphere of argon to form a second mixture; adding lithium triethylborohydride to the second mixture at a temperature in a processing temperature range from about 250° C. to about 350° C. forming a third mixture; incubating the third mixture at a temperature within the processing temperature range for at least about 3 hours to form nanoparticles comprising a soft magnetic phase with dimension of less than 50 nm; purifying the nanoparticles comprising a soft magnetic phase by precipitation using a non aqueous polar protic solvent; and heating the nanoparticles comprising a soft magnetic phase at about 500° C. under inert atmosphere.

DRAWINGS

These and other features, aspects, and advantages of the invention will become better understood when the following detailed description is read with reference to the accompanying drawings in which like characters represent like parts throughout the drawings, wherein.

DETAILED DESCRIPTION

Figure 1:
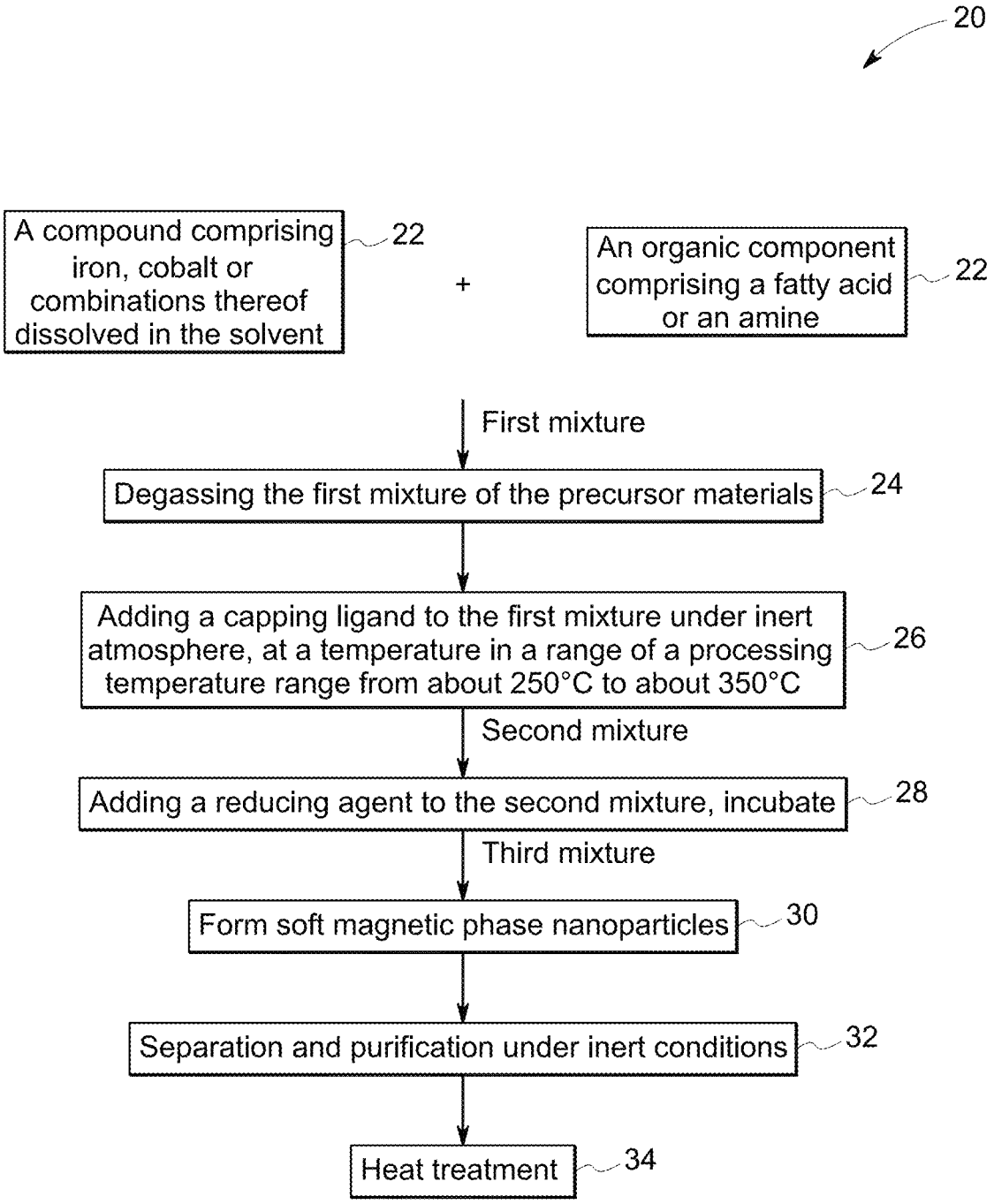
FIG. 1 is a flow chart of a process for making nanoparticles comprising a soft magnetic phase, in accordance with embodiments of the present invention.

Typically, magnetic nanoparticles used for various applications are commercially available, however, magnetic properties of the nanoparticles may be improved while synthesizing by a method of the present invention. The desired magnetic property may include better crystallinity, phase structure or phase purity, which typically enhance the magnetic performance. The present invention provides a methodology to generate nanoparticles comprising soft magnetic phase with minimal coatings and maximized crystallinity using a reduction at elevated temperatures. The method is an inexpensive and efficient process for preparing high-quality magnetic nanoparticles with monodisperse magnetic elemental and alloy nanoparticles.

Embodiments of a method are provided herein, the method comprises degassing a first mixture at a temperature in a range from about 80° C. to 130° C., wherein the first mixture comprising a solvent, a compound comprising iron, cobalt or combinations thereof dissolved in the solvent, and an organic component comprising a fatty acid or an amine; and adding a capping ligand to the first mixture under inert atmosphere to form a second mixture, adding a reducing agent to the second mixture at a temperature in a processing temperature range from about 250° C. to about 350° C. to form a third mixture and incubating the third mixture at a temperature within the processing temperature range to form nanoparticles comprising a soft magnetic phase. The soft magnetic phase may have relatively high magnetization. The terms "nanoparticles comprising soft magnetic phase" and "soft magnetic phase nanoparticles" are interchangeably used herein after.

In one or more embodiments, the method further comprises purifying the soft magnetic phase nanoparticles by precipitation using a solvent. In some embodiments, the precipitation is effected by using an anti-solvent. The term "anti-solvent" used herein refers to a solvent in which the product is insoluble and addition of the anti-solvent drastically reduces the solubility of the desired product. In some embodiments, the solvent is a non-aqueous polar protic solvent, for example, methanol or ethanol. In an exemplary embodiment, the synthesized nanoparticles are transferred to a glovebox with an inert atmosphere, for further downstream procedures. The nanoparticles inside the glovebox are precipitated by adding a polar protic solvent, such as ethanol (5:1) into the reaction mixture. The precipitated nanoparticles are separated using a permanent magnet. The nanoparticles are re-suspended in hexanes and further precipitated using ethanol. In some embodiments, the process is repeated for one or more time. The nanoparticles are dried under vacuum using a vacuum pump connected to the glovebox. The dry powder of nanoparticle is used for all further steps.

In some embodiments, the method further comprises heating the dry powdered form of the soft magnetic phase nanoparticles at about 500° C. under inert atmosphere to form a soft magnetic phase nanoparticles with saturation magnetization of at least about 200 emu/g. The heat treatment of the soft magnetic phase nanoparticles results in magnetic nanoparticles with improved phase structure possessing superior saturation magnetization value without increasing the size.

FIG. 1 illustrates a flow chart 20 for a method of making soft magnetic phase nanoparticles. At step 22, precursor materials, such as compound comprising iron, cobalt or combinations thereof and an organic component comprising a fatty acid or an amine may be provided. In one embodiment, the precursor materials may be provided as a blend. The precursor materials may be mixed to form a first mixture. The precursor materials may be mixed using a stirrer, such as a magnetic stirrer. In step 24, the first mixture may be subjected to degassing. In some embodiments, the degassing is effected at a temperature in a range of 80° C. to 130° C. In one exemplary embodiment, the degassing may be effected at a temperature of 100° C. Step 26 provided adding a capping ligand to the degassed first mixture under inert atmosphere, at a temperature in a range of a processing temperature range from about 250° C. to about 350° C., to form a second mixture. In step 28, a reducing agent may be added to the second mixture. The second mixture may be incubated for at least about 2 hours. In some embodiments, the second mixture may be incubated for about 2 to 10 hours. In one embodiment, the second mixture may be incubated for 3 hours to form a soft magnetic phase nanoparticles 30. In step 32, the soft magnetic phase nanoparticles are separated and purified. The synthesized nanoparticles may be isolated and purified by precipitation using anti-solvents under inert atmosphere. In one or more embodiments of the method, the purified nanoparticles are heat treated, 34, at about 500° C. to achieve improved saturation magnetization of the nanoparticles.

As noted, the method comprises degassing 24 a first mixture 22 comprising a solvent, a compound comprising iron, cobalt or combinations thereof dissolved in the solvent, and an organic component comprising a fatty acid or an amine. In one or more embodiments, the first mixture is degassed 24 at a temperature in a range of 80° C. to 130° C. In some other embodiments, the degassing of the first mixture is effected at a temperature in a range from about 100° C. to 130° C. In one embodiment, the degassing of the first mixture is effected at a temperature of about 100° C. A temperature greater than 130° C. may cause removal of the solvents and surfactants from the mixture and hinders the synthetic process. A temperature below 80° C. may not be sufficient for complete degassing of the mixture. In some embodiments, the degassing 24 of the mixture is optimized at about 100° C., in some other embodiments, the first mixture is degassed 24 at about 130° C. The step of degassing may be performed in a vacuum environment, an environment with reduced pressure, or in the presence of an inert gas. Degassing 24 may aid in removal of at least a portion of a surfactant, and/or undesirable gases such as oxygen.

In one or more embodiments, the compound comprises halides of iron, cobalt or combinations thereof. In some embodiments, the halides comprise iron bromide, cobalt bromide or combinations thereof. In one embodiment, the halides comprise iron (II) bromide, cobalt (II) bromide, Nickel (II) bromide, Platinum (II) bromide or combinations thereof. In one or more embodiments, the soft magnetic phase nanoparticles further comprise iron nickel, iron platinum, cobalt platinum or combinations thereof. In one or more embodiments, the invention produces intermetallics, e.g., CoPt, FePt, binary alloys e.g., Co/Ni, CoFe, and Fe/Ni and ternary alloys (e.g., Co/Fe/Ni).

As noted, the compounds, such as halides are dissolved in a solvent. In some embodiments, the solvent has a boiling point more than 250° C. In one or more embodiments, the solvent comprises diphenyl ether, di-decyl ether, di-octyl ether, di-dodecylether, octadecene or combinations thereof. The phenylether or n-octylether may be used as the solvent due to their low cost and high boiling point. In one example, an amount of the solvent may be in a range from about 55% by weight to about 300% by weight of the weight of the precursor material. The remaining solvent after formation of the product may be removed by precipitation purification technique. Solvent-free dried magnetic nanoparticles comprising a soft magnetic phase is desirable for downstream applications.

Typically the method employed a surfactant comprises an "organic stabilizer" which is a long chain organic component. The surfactant may be added to the mixture of the precursor material and solvent. In one embodiment, it may be desirable to use surfactants that do not contain oxygen. For example, during processing of the precursor material, the oxygen-containing surfactants may result in undesirable oxidation of the resultant nanoparticles. Non-limiting examples of the surfactant may include fatty acids or fatty amines having medium to long carbon chains. In one or more embodiments of the method, the organic components used for synthesizing magnetic nanoparticles comprise a fatty acid or an amine comprising 8 to 26 carbon atoms. In some embodiments, the organic components used for synthesizing magnetic nanoparticles comprise a fatty acid or an amine comprising 10 to 20 carbon atoms. In one or more embodiments, the functional groups, such as acid or amine of the organic component may provide a chemical attachment to the nanoparticle surface. In one example, the surfactant may include a long hydrocarbon chain for acid or amine. In another example, the amine may have two hydrocarbon chains such as in dioctylamine or didodecylamine. In one embodiment, an amount of surfactant used may be in a range from about 5% by weight to about 50% by weight of the total weight of the precursor material.

The organic component may comprise carboxylic acid, primary amine, secondary amine or tertiary amine. The organic component may comprise long chain fatty acids, wherein the examples of fatty acids may include myristic acid, dodecanoic acid, oleic acid, erucic acid, caprylic acid, linoleic acid, other long chain fattyacids or combinations thereof. In other embodiments, amine may comprise oleyl amine, decylamine, tetradecylamine, stearyl amine, tallow amine or other long chain amine surfactants. In one example, a combination of phosphines and organic components may provide controlled particle growth and stabilization. For example, to achieve optimum growth of the magnetic nanoparticles, oleic acid is employed in combination with phosphine. In one embodiment, the organic component comprises oleic acid, which may act as a stabilizer. In some embodiments, the oleic acid is used to protect iron nanoparticles. The oleic acid has an 18 carbon chain which is about 20 angstroms long with one double bond. A significant steric barrier is provided by the relatively long chain of oleic acid, which counteracts with the strong magnetic interaction between the particles. In some embodiments, other long chain carboxylic acids like erucic acid or linoleic acid may be added to oleic acid.

In one or more embodiments, the method employs capping ligands, wherein the capping ligand is added to the first mixture 26. The capping ligands typically attach to the surface of the nanoparticles either by chemical or physical attachment. The function of the capping ligands is to control the size of the nanoparticles during nanoparticle synthesis and induce stability to suspend nanoparticles in a suitable solvent. In some embodiments, the capping ligand used for the present method comprises trialkylphosphine, triarylphosphine or combinations thereof. In some embodiments, the iron or cobalt particles are stabilized by a combination of oleic acid and trialkylphosphine. A plurality of different phosphines may be used as capping ligands, such as symmetric tertiary phosphines (e.g., tributyl, trioctyl, triphenyl etc.), asymmetric phosphines (e.g., dimethyl octyl phosphine) or combinations thereof. In one embodiment, trialkylphosphine is selected as one capping ligand because it is a well-known ligand to stabilize zero valent metal due to a σ-donating and π-back bonding characteristics. In one embodiment, the capping ligand is trioctylphosphine or TOP. The addition of capping ligand to the first mixture forms a second mixture.

As noted, the reducing agent is added to the second mixture 28 to form a third mixture. In one or more embodiments, the reducing agent comprises a hydride source. In some embodiments, the reducing agent comprises metal hydride. In some embodiments, the metal hydride comprises lithium hydride, sodium hydride, rubidium hydride, cesium hydride, lithium aluminum hydride, sodium aluminum hydride or combinations thereof. In one embodiment, the reducing agent is lithium triethylborohydride, which is commercially known as superhydride.

The third mixture is incubated at a processing temperature range 30 to form desired nanoparticles. The reaction may be executed at a temperature, as referred to herein as a "processing temperature". The processing temperature range may be selected depending on the requirement of the process-efficiency or required property of the nanoparticles, such as $M_{sat}$ as sown in Table 1. The processing temperature range of the reaction mixture may attain after adding the capping ligand 26 to the first mixture and may be maintained till end of the reaction that is the formation of the nanoparticles comprising a soft magnetic phase 30. In some embodiments, the capping ligand is added to the mixture under inert atmosphere to form a second mixture, followed by heating the second mixture to a temperature in a processing temperature range from about 250° C. to about 350° C. The particle growth is hampered at a lower or a higher temperature beyond the range of 250° C. to about 350° C. In some embodiments, the temperature of the reaction for generating soft phase magnetic nanoparticles is optimized to be in a range of 270° C. to 300° C. In one exemplary embodiment, the reaction temperature is optimized to be about 290° C. The optimization of the processing temperature is demonstrated in Table 1, with further details. In some embodiments, the processing temperature may be same or different than the degassing temperature. In one embodiment, the processing temperature of the reaction is different than the degassing temperature.

As noted, the third mixture is incubated to form nanoparticles comprising a soft magnetic phase. In one or more embodiments, the third mixture is incubated at a temperature within the processing temperature range for at least about 2 to 10 hours to form nanoparticles comprising a soft magnetic phase. In some embodiments, the mixture is incubated at a temperature within the processing temperature range for at least about 3 hours to form desired nanoparticles comprising a soft magnetic phase. Heat treatment for a long time increases the crystallinity thereby improving the magnetic properties of the nanoparticles. However, heating for a prolonged period may lead to oversized particle growth and agglomerations. For the synthesis of Fe, Co or FeCo nanoparticles, 3 hours incubation may be an ideal condition balancing both the processes.

The entire synthesis process is subjected under inert atmosphere except degassing. As used herein, "inert atmosphere" refers to a condition where the reaction is covered in a blanket of inert gases such as nitrogen or argon. The inert atmosphere prevents the interference of atmospheric oxygen, humidity or both with the reaction. Exposure to oxygen or humidity results in oxidation of the nanoparticles, which may lead to impure phases in the product resulting in poor magnetic behavior. In one or more embodiments, the method synthesizes magnetic nanoparticles under an inert atmosphere. In some embodiments, the inert atmosphere comprises a noble gas, such as nitrogen, argon or combinations thereof. In one or more embodiments, the magnetic nanoparticles synthesize under nitrogen atmosphere.

The present method achieves nanoparticles with desired stoichiometry, size and magnetic properties. The magnetic properties may include, but are not limited to, saturation magnetization, a specific coercivity, magnetocrystalline anisotropy, unsaturated loops, superparamagnetic, ferromagnetic, low or high remanence ratio, single phase-like magnetization, amorphous structure, and exchange coupling. A chemical composition, morphology, a size, an orientation, a crystallographic structure, a microstructure of the nanoparticles may be varied. In one embodiment, the morphology of the soft magnetic phase nanoparticles may include, but is not limited to, shape, size, aspect ratio, or crystalline nature (e.g., monocrystalline, polycrystalline, amorphous). Non-limiting examples of the shape of the soft magnetic phase nanoparticles may include spherical, aspherical, elongated, cube, hexagonal, or combinations thereof.

Figure 2A:
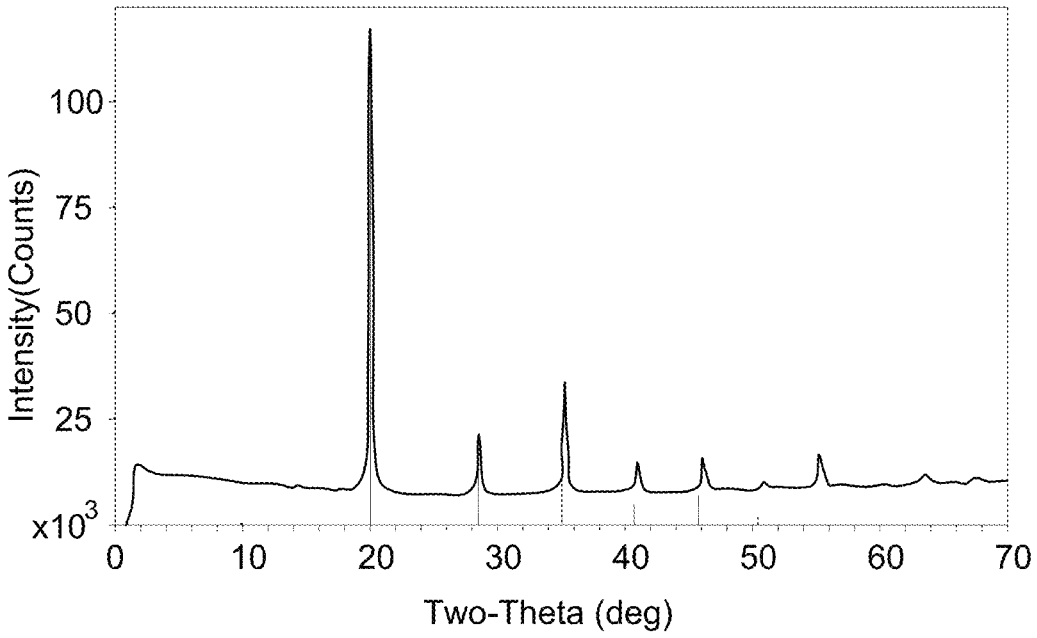
FIG. 2A is an X-ray diffraction (XRD) pattern of the iron nanoparticles, in accordance with embodiments of the present invention.
Figure 2B:
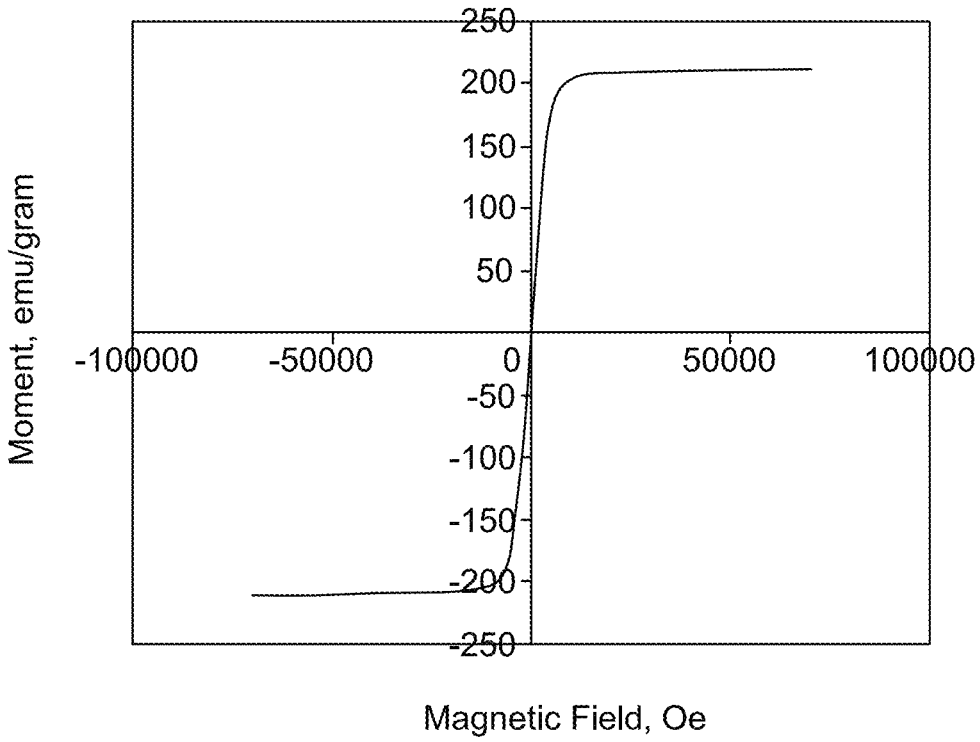
FIG. 2B is a graphical representation of magnetic saturation levels of the same iron nanoparticles represented in FIG. 2A, in accordance with embodiments of the present invention.
Figure 4A:
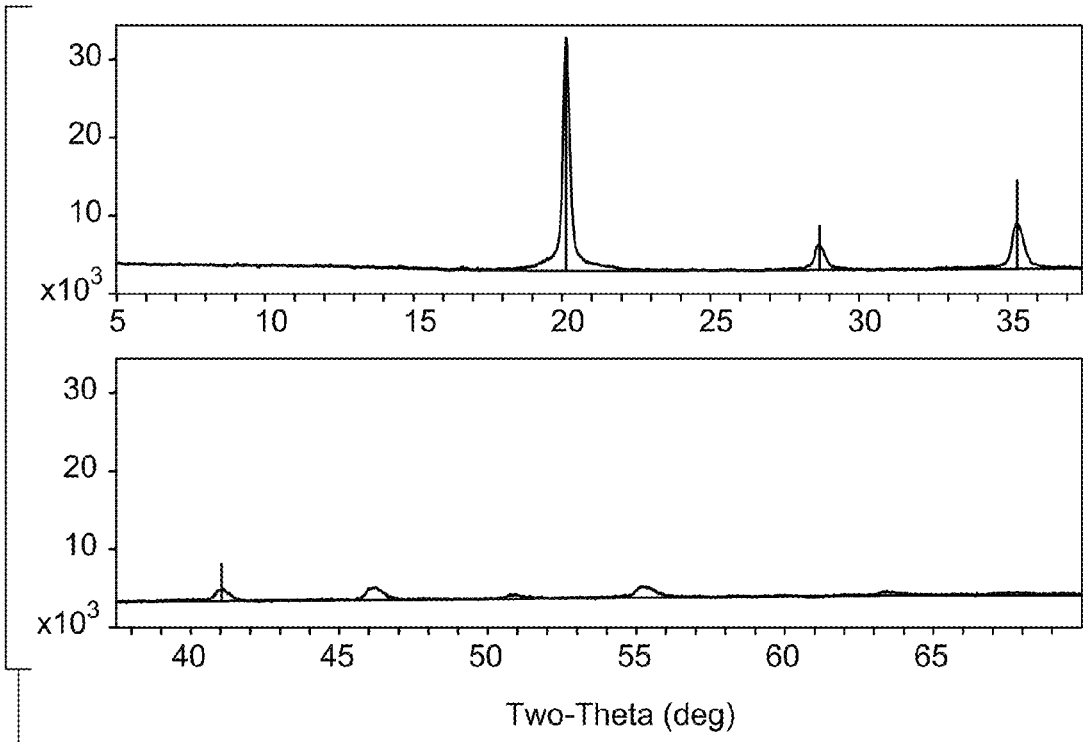
FIG. 4A is an XRD pattern of the iron-cobalt nanoparticles, in accordance with embodiments of the present invention.
Figure 4B:
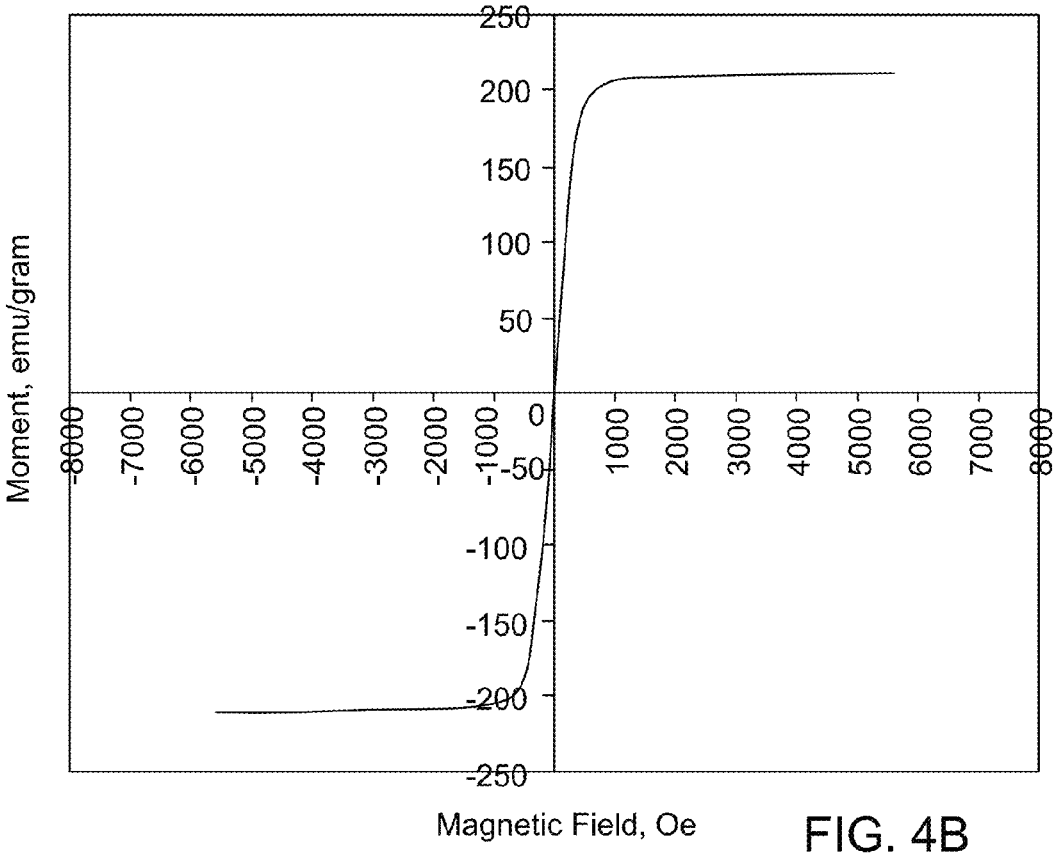
FIG. 4B is a graphical representation of magnetic saturation levels of the same iron-cobalt nanoparticles represented in FIG. 4A, in accordance with embodiments of the present invention.

The saturation magnetization value of soft magnetic phase nanoparticles may vary depending on various factors, such as heat treatment during synthesis or use of different chemical reagents. In one embodiment, an XRD analysis of the nanoparticles comprising iron indicates pure body centered cubic (bcc) iron structure, as shown in FIG. 2A with $M_{sat}$ value of 210 emu/g. The term "body-centered cubic (bcc)" refers to the specific internal crystal structure of the particles which may determine the anisotropy of the magnetic properties. The vertical lines are peaks expected for a sample of crystalline α-iron. FIG. 2B illustrates saturation magnetization levels of iron nanoparticles. In the illustrated embodiment, the saturation levels for the iron particles having a size of less than about 50 nm may be about 200 emu/g. The nanoparticles may demonstrate high $M_{sat}$ values that are close to a theoretical maximum value. In one embodiment, the saturation magnetization value or $M_{sat}$ of magnetic nanoparticles comprising iron is at least about 210 emu/g, as shown in FIG. 2B. In one embodiment, an XRD analysis of the nanoparticles comprising iron cobalt indicates pure bcc structure, as shown in FIG. 4A with $M_{sat}$ value of 220 emu/g, as shown in FIG. 4B. The vertical lines represent the expected peaks for a crystalline iron-cobalt material.

Figure 3A:
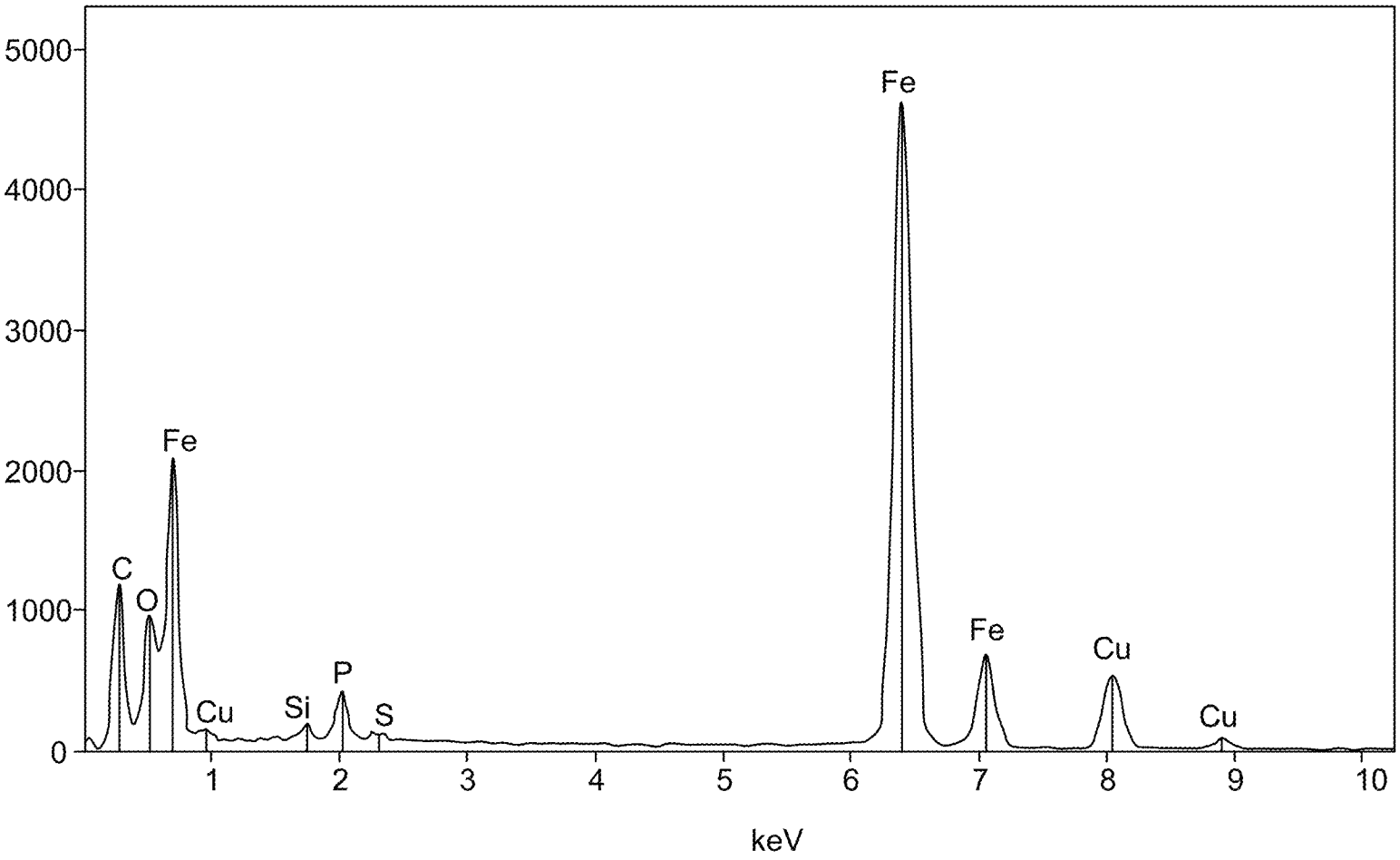
FIG. 3A is an Energy Dispersive Spectroscopy (EDS) pattern of the iron nanoparticles synthesized in accordance with embodiments of the present invention.
Figure 5:
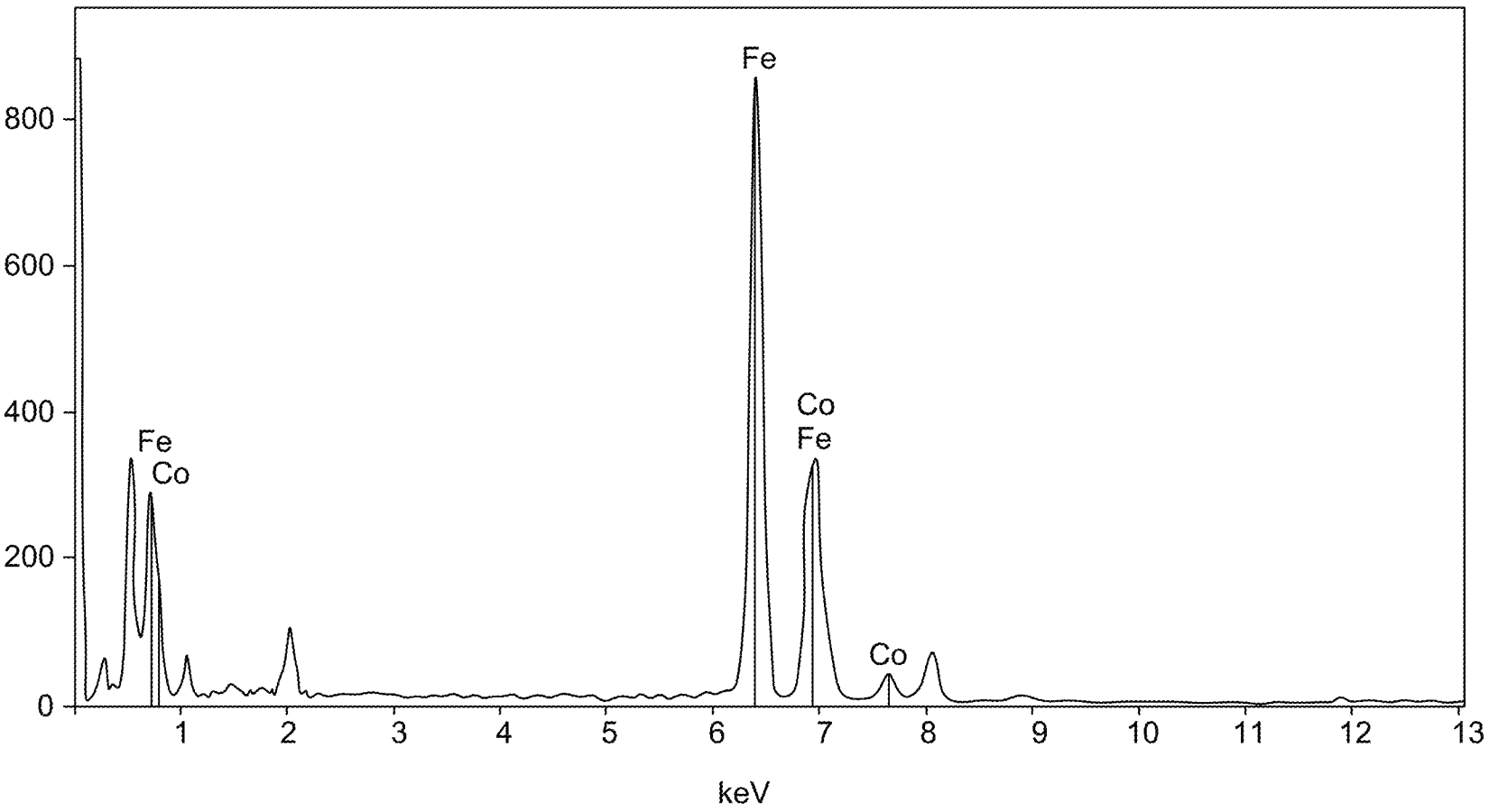
FIG. 5 is an EDS pattern of the iron-cobalt nanoparticles synthesized in accordance with embodiments of the present invention.

As used herein, the term "nanoparticles" may refer to particles having a smallest dimension (such as a diameter or thickness) in a range from about 1 nm to about 1000 nm. In one or more embodiments, the soft magnetic phase nanoparticles have a dimension between 2 nm to 200 nm. In one embodiment, the nanoparticles of the soft magnetic phase may have a size in a range from about 1 nm to about 50 nm. In some embodiments, the magnetic phase nanoparticles have dimension of about 4 nm to 50 nm. The TEM image and EDS pattern of the Fe nanoparticles synthesized is represented in FIG. 3A. A size of the iron nanoparticle may be less than about 50 nm, as reflected from the TEM image of FIG. 3B. The EDS peaks correspond to Fe nanoparticles and the background peaks correspond to the ligand chemicals present in the nanoparticle. The size of the nanoparticles from the TEM image corresponds to about 5 nm. A size of the iron cobalt (FeCo) nanoparticle may be less than about 5 nm, as reflected from FIGS. 6A and 6B. The EDS pattern of the FeCo nanoparticles synthesized is represented in FIG. 5, wherein the EDS peaks correspond to FeCo nanoparticles and the background peaks correspond to the ligand chemicals present in the nanoparticle. The size of the FeCo nanoparticles from the TEM image (FIGS. 6A and 6B) corresponds to about 5 nm.

Figure 6A:
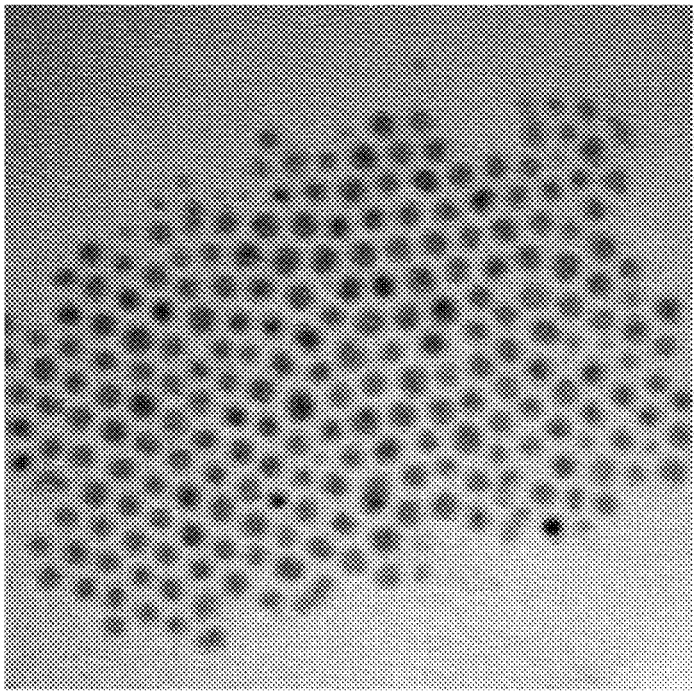
FIGS. 6A and 6B are TEM images of the iron-cobalt nanoparticles from a typical synthesis at two different magnifications, in accordance with embodiments of the present invention.
Figure 6B:
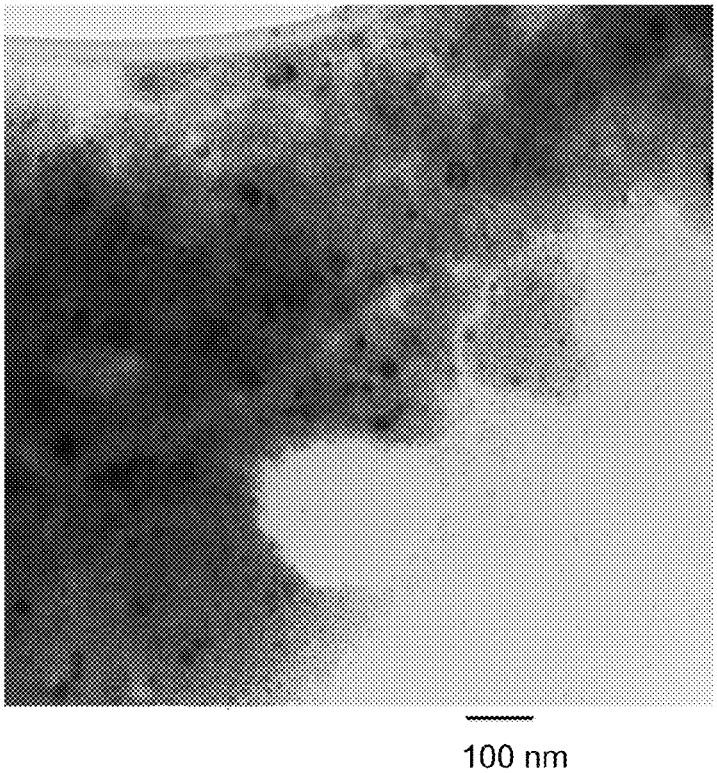

TEM images of FeCo nanoparticles at two different magnifications are shown in FIGS. 6A and 6B. Micrograph represents monodisperse FeCo nanoparticles of about 5 nm. In one embodiment, the soft magnetic phase nanoparticles may comprise mono-disperse particles (FIGS. 6A and 6B). The monodisperse nanoparticles may be synthesized by chemical reduction of metal precursors under inert atmosphere, in the presence of surfactants. The size of the nanoparticles may be controlled by reaction concentration, amount of surfactant, heating-rate, reaction temperature or combinations thereof.

In certain embodiments, the magnetic nanoparticles comprising soft magnetic phase disclosed herein may be used in diverse fields, such as, but not limited to, electronics, healthcare, information and communications, industrial, and automotive. In these embodiments, the magnetic nanoparticles may be used for small or large scale applications. In one embodiment, the magnetic nanoparticles may be employed in electric machines or drives, such as, but not limited to, generators, traction motors, compressor drives, gas strings and magnetic resonance imagers. By way of example, the magnetic nanoparticles may be used in electric motors for automobiles, generators for wind turbines, traction motors for hybrid vehicles, such as but not limited to, cars, locomotives, and magnetic resonance imaging applications.

One of the major applications of magnetic nanoparticles comprising soft magnetic phases may be for making nanocomposite permanent magnets. The magnetic properties of the nanoparticles of the hard and/or soft magnetic phases may be selected to provide a nanocomposite permanent magnet having desirable magnetic properties.

EXAMPLES

Example 1

Synthesis of Fe Nanoparticles Comprising a Soft Magnetic Phase

Materials: 1.5 g $FeBr_2$ (215.65, 7 mmol), 0.7 mL oleic acid (282.46, 2.2 mmol), 2.7 mL trioctylphosphine (370.64, 6 mmol), 40 mL diphenyl ether and 14 mL super hydride (1 M) (14 mmol) were used for synthesizing soft magnetic phase nanoparticles comprising Fe.

A 3-necked round bottom flask fitted with an air condenser and thermocouple was loaded with $FeBr_2$. The reaction flask was kept under an Argon atmosphere, wherein diphenyl ether (40 mL) was added using a syringe followed by addition of oleic acid (0.7 mL). This mixture was heated to 100° C., and incubated under vacuum for 1 hour for degassing. The reaction was switched back to inert atmosphere and trioctylphosphine (2.7 mL) was injected to the degassed mixture. The reaction mixture was heated to 290° C. and after attaining the temperature, super-hydride (14 mL of 1M solution in THF) was injected drop wise. This reaction was maintained at 290° C. for 3 hours followed by cooling to room temperature. The reaction under inert atmosphere was carefully transferred into glovebox where it was precipitated and washed multiple times before characterization.

The nanoparticle synthesized under inert atmosphere was transferred into a glovebox for all further steps. The nanoparticle inside the glovebox was precipitated by adding a polar protic solvent like ethanol (5:1) into the reaction mixture. The precipitated nanoparticle was separated and retained using a permanent magnet. The nanoparticle was re-suspended in hexanes and further precipitated using ethanol. The process was continued one more time and the nanoparticle was dried under vacuum by connection to a vacuum pump attached to the glovebox. The dry powder of nanoparticle was used for all further steps. Heat treatment was done in a quartz tube under an Argon atmosphere. Sample was transferred into a quartz tube fitted with a gas regulator inside the glovebox. The closed sample tube is transferred into the heat treatment-oven and connected to a supply of Argon gas. All further steps were carried out under a continuous flow of Argon. The temp ramp was carried out as follows: (i) from room temp to 300° C., 10° C./min; (ii) from 300° C. to 500° C., 5° C./min; (iii) 30 min at 500° C., then natural cooling back to room temp. The sample was isolated using the regulator before transferring into the glovebox.

Example 2

Synthesis of FeCo Nanoparticles Comprising a Soft Magnetic Phase

Materials: 1.5 g $FeBr_2$ (215.65, 7 mmol), 0.654 g $CoBr_2$ (218.74, 3 mmol), 0.7 mL oleic acid (282.46, 2.2 mmol), 2.7 mL trioctylphosphine (370.64, 6 mmol), 40 mL diphenyl ether and 20 mL super-hydride (1 M) (20 mmol) were used for synthesizing soft magnetic phase nanoparticles comprising FeCo.

A 3-necked round bottom flask fitted with an air condenser and thermocouple was loaded with $FeBr_2$ and $CoBr_2$. To this reaction flask kept under an Argon atmosphere, diphenyl ether (40 mL) was syringed in followed by oleic acid (0.7 mL). The mixture was heated to 100° C., and left under vacuum for 1 hour. The reaction was switched back to inert atmosphere and trioctylphosphine (4 mL) was injected. The reaction was heated to 290° C. and after attaining the temperature, superhydride (20 mL of 1M solution in THF) was injected drop wise. The reaction was maintained at 290° C. for 3 hours followed by cooling to room temperature. The reaction under inert atmosphere was carefully transferred into glovebox where it was precipitated and washed multiple times before characterization.

The nanoparticle synthesized under inert atmosphere was transferred into a glovebox for all further steps. The nanoparticle inside the glovebox was precipitated by adding a polar protic solvent like ethanol (5:1) into the reaction mixture. The precipitated nanoparticle was separated and retained using a permanent magnet. The nanoparticle was re-suspended in hexanes and further precipitated using ethanol. The process was continued one more time and the nanoparticle was dried under vacuum by connection to a vacuum pump connected to the glovebox. The dry powder of nanoparticle was used for all further steps. Heat treatment was done in a quartz tube under an Argon atmosphere. Sample was transferred into a quartz tube fitted with a gas regulator inside the glovebox. The closed sample tube is transferred into the heat treatment oven and connected to a supply of Argon gas. All further steps were carried out under a continuous flow of Argon. The temp ramp was carried out as follows: (i) from room temp to 300° C., 10° C./min; (ii) from 300° C. to 500° C., 5° C./min; (iii) 30 min at 500° C., then natural cooling back to room temp. The sample was isolated using the regulator before transferring into the glovebox.

Example 3

Optimization of Reduction Temperature

Three different sets of reaction mixtures were prepared. For each set, a 3-necked round bottom flask fitted with an air condenser and thermocouple was loaded with $FeBr_2$. The reaction flask was kept under an Argon atmosphere, wherein diphenyl ether (40 mL) was added using a syringe followed by addition of oleic acid (0.7 mL). This mixture was heated to 100° C., and incubated under vacuum for 1 hour for degassing. The reaction was switched back to inert atmosphere and trioctylphosphine (2.7 mL) was injected to the degassed mixture.

The reaction mixtures for three different sets were heated to 200° C., 250° C. and 290° C. and after attaining the temperature; super-hydride (14 mL of 1M solution in THF) was injected drop wise. The reaction was maintained at 200° C., 250° C. and 290° C. for 3 hours followed by cooling to room temperature. The reaction under inert atmosphere was carefully transferred into glovebox where it was precipitated and washed multiple times before characterization.

The nanoparticle synthesized under inert atmospheres was transferred into a glovebox for all further steps. The nanoparticle inside the glovebox was precipitated by adding a polar protic solvent like ethanol (5:1) into the reaction mixture. The precipitated nanoparticle was separated and retained using a permanent magnet. The nanoparticle was re-suspended in hexanes and further precipitated using ethanol. The process was continued one more time and the nanoparticle was dried under vacuum by connection to a vacuum pump connected to the glovebox.

The dry powder of nanoparticle was used for determining saturation magnetization of each of the three products using the method described in Example 5. The maximum $M_{sat}$ value was determined for the reaction mixture that was reduced at a temperature of about 290° C., as also shown in Table 1.

TABLE 1

Optimization of reduction temperature

| Reduction Temperature (° C.) | $M_{sat}$ (emu/g) |
|---|---|
| 200 | 188 |
| 250 | 200 |
| 290 | 210 |

Example 4

Characterization of Synthesized Nanoparticles by XRD

All magnetic measurements reported were carried out at room temperature. Sizes of the nanoparticles were broadly <20 nm. XRD was performed on an EQUINOX 5000 Inel machine (50 KV*80 mA) fitted with Rigaku rotating anode X-ray generator and Intel curved 1-D position sensitive detector. Data was generated using MoK radiation in the transmission mode. The sample was mounted on a sealed spinning glass capillary inside the glovebox prior to measurements. The XRD pattern of Fe nanoparticles and FeCo nanoparticles are represented in FIG. 2A and FIG. 4A respectively. The XRD pattern of FIG. 2A is characteristic of bcc Iron and the absence of any impurity peaks confirms the quantitative formation of Fe nanoparticles from the process. Similarly the XRD pattern of FIG. 4A is characteristic of bcc FeCo and the absence of any impurity peaks confirms the quantitative formation of FeCo nanoparticles from the process.

Example 5

Measurement of Saturation Magnetization of Synthesized Nanoparticles

The purified Fe nanoparticles were transferred to a plastic sample holder inside the glovebox. The magnetic hysteresis was performed on a Physical Property Measurement System (PPMS) from Quantum Design. The measurement was carried out at room temperature with a field sweep of ±7 tesla. The system was equipped with a sealed sample chamber. The saturation level of the nanoparticles was about 210 emu/g, which is very close to the theoretical maximum thus exemplifying the quality of these nanoparticles. FIG. 2B is a graphical representation of magnetic saturation levels of iron nanoparticles, Example 6

EDS and TEM Characterization of Synthesized Nanoparticles

Figure 3B:
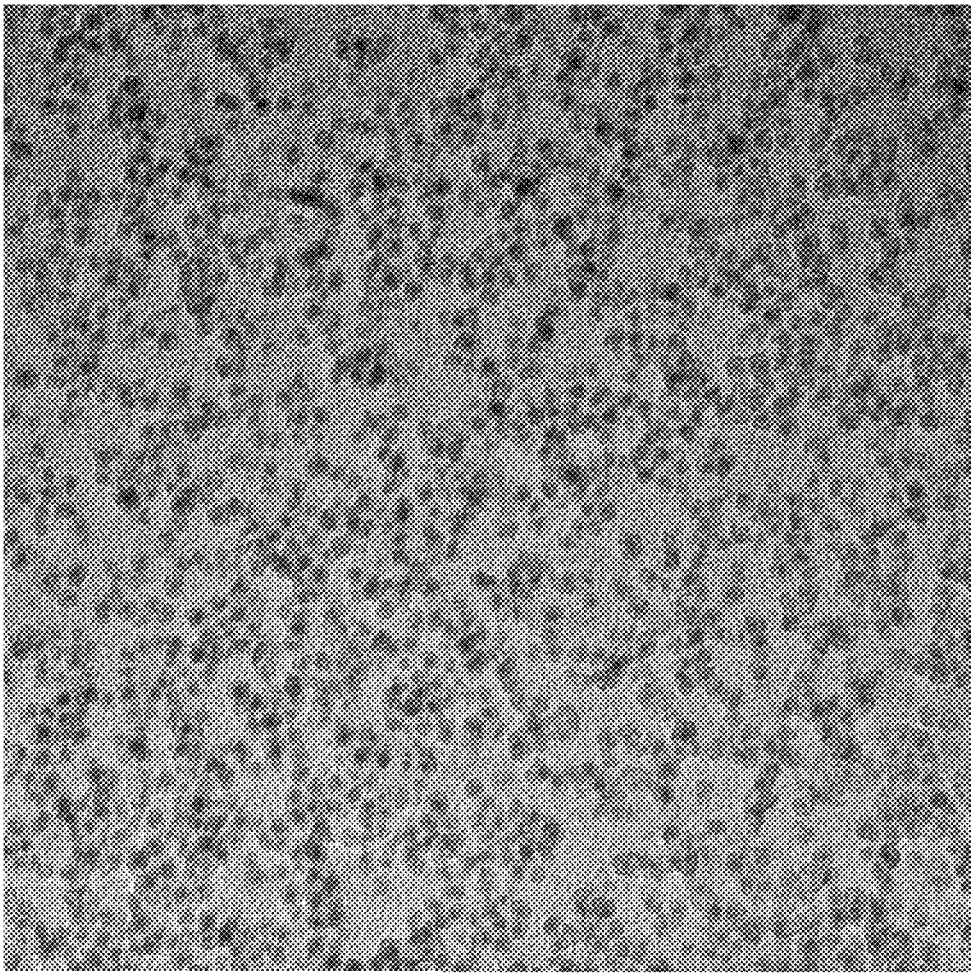
FIG. 3B is a Transmission Electron Microscopy (TEM) image of the same iron nanoparticles, in accordance with embodiments of the present invention.

EDS pattern of the synthesized Fe nanoparticles was determined. The spot EDS was performed under convergent beam mode. The EDS peaks correspond to Fe nanoparticles and the background peaks correspond to the ligand chemicals present in the nanoparticle was observed in FIG. 3A. The size of the nanoparticles from the TEM image (as shown in FIG. 3B) was determined as about 5 nm. The TEM image of the nanoparticles was analyzed using a FEI Tecnai 200 kV system fitted with a Thermo Scientific EDS system. The EDS peaks correspond to FeCo nanoparticles and the background peaks correspond to the ligand chemicals present in the nanoparticle was observed in FIG. 5. The size of the FeCo nanoparticles from the TEM images corresponds to about 5 nm in which was represented in FIGS. 6A and 6B in 20 nm and 100 nm magnification.

While only certain features of the invention have been illustrated and described herein, many modifications and changes will occur to those skilled in the art. It is, therefore, to be understood that the appended claims are intended to cover all such modifications and changes as fall within the scope of the invention.

The invention claimed is:

1. A method comprising:

degassing a first mixture at a temperature in a range from about 80° C. to 130° C., wherein the first mixture comprises a solvent, a compound comprising iron bromide, cobalt bromide, or combinations thereof dissolved in the solvent, and an organic component comprising a fatty acid or an amine;

adding a capping ligand to the first mixture under inert atmosphere to form a second mixture;

adding a reducing agent to the second mixture at a temperature in a processing temperature range from about 250° C. to about 350° C. to form a third mixture; and incubating the third mixture at a temperature within the processing temperature range to form nanoparticles comprising a soft magnetic phase.

2. The method of claim 1, further comprising purifying the nanoparticles comprising a soft magnetic phase by precipitation using utilizing a solvent.

3. The method of claim 2, wherein the solvent is a non-aqueous polar protic solvent.

4. The method of claim 1, further comprising heating the nanoparticles comprising a soft magnetic phase at about 500° C. under an inert atmosphere to form nanoparticles with saturation magnetisation of at least about 200 emu/g.

5. The method of claim 1, wherein degassing the first mixture is effected at a temperature in a range from about 100° C. to 130° C.

6. The method of claim 1, wherein the compound comprises iron (II) bromide, cobalt (II) bromide or combinations thereof.

7. The method of claim 1, wherein the solvent has a boiling point more than 250° C.

8. The method of claim 1, wherein the solvent comprises diphenyl ether, di-decyl ether, di-dodecylether, octadecene or combinations thereof.

9. The method of claim 1, wherein the organic component comprises a fatty acid or an amine having 8 to 26 carbon atoms.

10. The method of claim 1, wherein the fatty acids or amines comprise myristic acid, dodecanoic acid, oleic acid, decylamine, tetradecylamine, oleyl amine or combinations thereof.

11. The method of claim 1, wherein the inert atmosphere comprises a noble gas.

12. The method of claim 1, wherein the inert atmosphere comprises nitrogen, argon or combinations thereof.

13. The method of claim 1, wherein the nanoparticles comprising a soft magnetic phase further comprise iron nickel, iron platinum, cobalt platinum or combinations thereof.

14. The method of claim 1, wherein the processing temperature is about 290° C.

15. The method of claim 1, wherein the third mixture is incubated at a temperature within the processing temperature range from about 2 hours to 10 hours.

16. The method of claim 1, wherein the third mixture is incubated at a temperature within the processing temperature range for at least about 3 hours.

17. The method of claim 1, wherein the reducing agent comprises a hydride source.

18. The method of claim 1, wherein the reducing agent comprises a metal hydride.

19. The method of claim 1, wherein the reducing agent comprises lithium triethylborohydride.

20. The method of claim 1, wherein the capping ligand comprises trialkylphosphine, triarylphosphine or combinations thereof.

21. The method of claim 1, wherein the capping ligand is trioctylphosphine.

22. The method of claim 1, wherein the soft magnetic phase nanoparticles comprise $M_{sat}$ value of at least about 200 emu/g.

23. The method of claim 1, wherein the soft magnetic phase nanoparticles have a dimension between 2 nm to 200 nm.

24. The method of claim 1, wherein the magnetic phase nanoparticles have dimension of about 4 nm to 50 nm.

25. A method, comprising:

degassing a first mixture at a temperature of about 100° C., wherein the mixture comprises diphenyl ether as a solvent, an iron bromide dissolved in diphenyl ether, and an organic component comprising a fatty acid or an amine having 10 to 20 carbon atoms;

adding trioctylphosphine under inert atmosphere of argon to form a second mixture;

adding lithium triethylborohydride to the second mixture at a temperature in a processing temperature range from about 250° C. to about 350° C. forming a third mixture;

incubating the third mixture at a temperature within the processing temperature range for at least about 3 hours to form nanoparticles comprising a soft magnetic phase with dimension of less than 50 nm;

purifying the nanoparticles comprising a soft magnetic phase by precipitation using a non aqueous polar protic solvent; and heating the nanoparticles comprising a soft magnetic phase at about 500° C. under inert atmosphere.

26. The method of claim 25, wherein the fatty acids or amines comprise myristic acid, dodecanoic acids, oleic acid, decylamine, tetradecylamine, oleyl amine or combinations thereof.

* * * * *